US006776150B2

(12) United States Patent
Gaidjiergis et al.

(10) Patent No.: US 6,776,150 B2
(45) **Date of Patent: *Aug. 17, 2004**

(54) METHOD AND APPARATUS FOR CUTTING FIBER-CEMENT MATERIAL ALONG AN ARCUATE PATH

(75) Inventors: Joseph Gaidjiergis, Renton, WA (US); Scott C. Fladgard, Kingston, WA (US)

(73) Assignee: Shear Technologies, Inc., Kingston, WA (US)

( * ) Notice: Subject to any disclaimer, the term of this patent is extended or adjusted under 35 U.S.C. 154(b) by 269 days.

This patent is subject to a terminal disclaimer.

(21) Appl. No.: 09/924,395

(22) Filed: Aug. 7, 2001

(65) Prior Publication Data

US 2002/0066447 A1 Jun. 6, 2002

Related U.S. Application Data

(63) Continuation of application No. 09/506,149, filed on Feb. 17, 2000, now abandoned, which is a continuation-in-part of application No. 09/436,790, filed on Nov. 8, 1999, now Pat. No. 6,250,998, which is a continuation of application No. 09/036,249, filed on Mar. 6, 1998, now Pat. No. 5,993,303.

(51) Int. Cl.[7] ..... A46B 13/00
(52) U.S. Cl. ..... 125/23.01; 457/356; 30/228
(58) Field of Search ..... 451/340, 356; 125/23.01, 30.01, 40; 30/228, 134, 258

(56) References Cited

U.S. PATENT DOCUMENTS

| | | | |
|---|---|---|---|
| 1,447,567 | A | 3/1923 | Overbury |
| 1,495,070 | A | 5/1924 | Finley |
| 1,732,403 | A | 10/1929 | Harris et al. |
| 1,814,151 | A | 7/1931 | Gundlach |
| 1,872,185 | A | 8/1932 | Reade |
| 1,959,960 | A | 5/1934 | Magrath |
| 1,981,695 | A | 11/1934 | Gundlach |
| 2,142,181 | A | 1/1939 | Croce |
| 2,149,741 | A | 3/1939 | Miles |
| 2,171,010 | A | 8/1939 | Schuetz et al. |
| 2,174,098 | A | 9/1939 | Stein |
| 2,187,203 | A | 1/1940 | Johnston |
| 2,199,760 | A | 5/1940 | Schuetz |
| 2,411,016 | A | 11/1946 | Azzara |
| 2,746,447 | A | 5/1956 | Petch |
| 2,808,822 | A | 10/1957 | Celapino |
| 2,874,688 | A | 2/1959 | Biesanz, Sr. et al. |
| 3,263,539 | A | 8/1966 | Daniel et al. |
| 3,297,015 | A | 1/1967 | Crawford |
| 3,524,374 | A | 8/1970 | Diolot |
| 3,608,261 | A | 9/1971 | French et al. |

(List continued on next page.)

FOREIGN PATENT DOCUMENTS

| | | |
|---|---|---|
| DK | 0048610 | 2/1919 |
| SU | 0745605 | 7/1980 |

*Primary Examiner*—George Nguyen
(74) *Attorney, Agent, or Firm*—Perkins Coie LLP

(57) ABSTRACT

A method and apparatus for cutting a fiber-cement material. An apparatus in accordance with one embodiment of the invention includes a blade assembly having an alignment member with a first finger portion and a spaced apart second finger portion. Each finger portion has a guide surface and the two guide surfaces define a guide plane. A reciprocating cutting member is pivotably coupled between the finger portions and is moveable relative to the finger portions transverse to the guide plane between a first position and a second position. The cutting member has a blade portion with outwardly facing side surfaces that have a first axial dimension when intersected by the guide plane with the blade in the first position and a second axial dimension, approximately equal to the first axial dimension, when intersected by the guide plane with the blade in the second position. The cutting tool can cut the fiber-cement material along an arcuate path having a radius approximately equal to the first and second axial dimensions.

29 Claims, 4 Drawing Sheets

U.S. PATENT DOCUMENTS 3,677,258 A 7/1972 Fletcher et al.
3,693,254 A 9/1972 Salonen
3,727,600 A 4/1973 Schlough
3,728,997 A 4/1973 Fletcher et al.
3,771,401 A 11/1973 Jasinski
3,830,687 A 8/1974 Re et al.
3,868,300 A 2/1975 Wheeler
3,886,927 A 6/1975 Chattin
3,899,344 A 8/1975 Jakel
3,927,501 A 12/1975 Allen et al.
3,958,480 A 5/1976 Rohde et al.
4,007,523 A * 2/1977 Bianco ..... 30/90.2
4,015,391 A 4/1977 Epstein et al.
4,057,087 A 11/1977 Oldenburg
4,173,069 A * 11/1979 Sidenstick et al. ..... 30/228
4,288,959 A 9/1981 Murdock
4,366,197 A 12/1982 Hanlon et al.
4,437,274 A 3/1984 Slocum et al.
4,468,909 A 9/1984 Eaton
4,598,522 A 7/1986 Hoofe, III
4,682,416 A * 7/1987 Stolfa ..... 30/228
4,694,717 A 9/1987 Boots
4,982,541 A 1/1991 Winter, IV
5,038,477 A * 8/1991 Parrow ..... 30/253
5,125,158 A * 6/1992 Casebolt et al. ..... 30/228
5,172,479 A * 12/1992 Keeton ..... 30/228
5,295,339 A 3/1994 Manner
5,353,504 A * 10/1994 Pai ..... 30/228
5,365,915 A * 11/1994 Yu ..... 125/23.02
5,395,026 A 3/1995 Yu
5,501,056 A 3/1996 Hannah et al.
5,566,454 A * 10/1996 Eisenbraun ..... 30/228
5,570,678 A * 11/1996 Waggoner et al. ..... 125/23.01
5,662,094 A 9/1997 Giacomelli
5,722,386 A * 3/1998 Fladgard et al. ..... 125/23.01
5,875,554 A * 3/1999 Vogelsanger ..... 30/228
5,993,303 A * 11/1999 Fladgard et al. ..... 451/356
6,067,766 A 5/2000 Badke
6,102,026 A 8/2000 Fladgard et al.
6,250,998 B1 * 6/2001 Fladgard et al. ..... 451/356
6,336,303 B1 1/2002 Vanderman et al.

* cited by examiner

METHOD AND APPARATUS FOR CUTTING FIBER-CEMENT MATERIAL ALONG AN ARCUATE PATH

CROSS-REFERENCE TO RELATED APPLICATIONS

This application is a continuation of U.S. application Ser. No. 09/506,149, abandoned which is a continuation-in-part of U.S. application Ser. No. 09/436,790, now U.S. Pat. No. 6,250,998, which is a continuation of U.S. application Ser. No. 09/036,249, now U.S. Pat. No. 5,993,303.

TECHNICAL FIELD

The present invention relates to methods and apparatuses for cutting fiber-cement along an arcuate path.

BACKGROUND OF THE INVENTION

The exteriors of houses and other types of buildings are commonly covered with siding materials that protect the internal structures from external environmental elements. The siding materials are typically planks or panels composed of wood, concrete, brick, aluminum, stucco, wood composites or fiber-cement composites. Wood siding is popular, but it is costly and flammable. Wood siding also cracks causing unsightly defects, and it is subject to infestation by insects. Aluminum is also popular, but it deforms easily, expands and contracts in extreme climates and is relatively expensive. Brick and stucco are also popular in certain regions of the country, but they are costly and labor-intensive to install.

Fiber-cements siding (FCS) offers several advantages compared to other types of siding materials. FCS is made from a mixture of cement, silica sand, cellulose and a binder. To form FCS siding products, a liquid fiber-cement mixture is pressed and then cured to form FCS planks, panels and boards. FCS is advantageous because it is non-flammable, weather-proof, and relatively inexpensive to manufacture. Moreover, FCS does not rot or become infested by insects. FCS is also advantageous because it may be formed with simulated wood grains or other ornamental designs to enhance the appearance of a building. To install FCS, a siding contractor cuts the panels or planks to a desired length at a particular job site. The siding contractor then abuts one edge of an FCS piece next to another and nails the cut FCS pieces to the structure.

After the FCS is installed, trim materials may be attached to the structure and the FCS may be painted.

Although FCS offers many advantages over other siding materials, it is difficult and expensive to cut. Siding contractors often cut FCS with a circular saw having an abrasive disk. Cutting FCS with an abrasive disk, however, generates large amounts of very fine dust that creates a very unpleasant working environment. Siding contractors also cut FCS with shears having opposing blades, as set forth in U.S. Pat. Nos. 5,570,678 and 5,722,386 which are herein incorporated by reference. Although the shears set forth in these patents cut a clean edge in FCS without producing dust, many siding contractors prefer to use a hand-held tool because they are accustomed to cutting siding with hand saws. Therefore, in light of the positive characteristics of FCS and the need for a hand-held cutting tool, it would be desirable to develop a hand-held cutting tool that quickly cuts clean edges through FCS without producing dust.

To meet the demand for a hand-held FCS cutting tool, the present inventors developed a hand-held tool with a reciprocating cutting blade (the "original hand held-tool"). The original hand-held tool had a motor-unit, a drive assembly coupled to the motor-unit to generate a reciprocating motion, and a blade set with a moving blade between first and second stationary fingers. The motor-unit was a 1046-90 Black and Decker® electric drill motor, and the drive assembly was a shear head manufactured by Kett Tool Co. of Cincinnati, Ohio. The moving blade was coupled to the Kett shear head to reciprocate between the first and second fingers. Additionally, the first and second fingers were spaced apart by 0.250 inches, and the cutting blade had a thickness of 0.185–0.200 inches. The sides of the cutting blade were accordingly spaced apart from the fingers by 0.025–0.0325 inches.

In the operation of the original hand-held tool, the fingers were placed on an FCS workpiece and the moving blade was driven from an open position below the workpiece to a closed position in the gap between the first and second fingers. As the blade moved from the open position to the closed position, it sheared the workpiece along both sides of the blade to form a cut in the workpiece approximately as wide as the gap between the first and second fingers. An operator would accordingly push the tool as the blade reciprocated between the open and closed positions to cut the workpiece.

One drawback of the original hand-held tool, however, was that the drive assembly and the motor-unit were subject to premature failure. One possible solution for reducing premature failure of the hand-held tool was to use stronger materials in the drive mechanism. Yet, using stronger materials would require more expensive metals that would increase the cost of the tools. Another possible solution for the original hand-held tool was to increase the size of the components of the motor unit and the drive mechanism. Using larger components, however, would increase the weight of the tools making them more difficult to handle. In addition to these constraints, cutting FCS without dust presents many challenges that are not present in other materials because FCS is a relatively brittle material that tends to crack along rough edges and unpredictable paths. As such, FCS cannot be cut with a thin blade unless it is in an opposing shear like those disclosed in U.S. Pat. Nos. 5,722,386 and 5,570,678. Thus, it would be desirable to develop a hand-held cutting tool that cuts a clean edge in FCS and is not subject to premature failure.

SUMMARY OF THE INVENTION

The present invention is directed toward methods and apparatuses for cutting fiber-cement materials. In one aspect of the invention, the apparatus can include a blade assembly for a reciprocating fiber-cement cutting tool. The assembly can include an alignment member attachable to the cutting tool. The alignment member generally has a first finger portion with a first guide surface and a first interior surface and a second finger portion with a second guide surface and a second interior surface. The first and second guide surfaces are positioned in a guide plane, and the first and second interior surfaces are spaced apart from one another. The blade assembly can further include a reciprocating cutting member between the first and second finger portions and movable relative to the finger portions and transverse to the guide plane between a first position and a second position. The cutting member can have a blade portion projecting from the guide plane and the blade portion can include a first side surface facing opposite the first interior surface and a second side surface facing opposite the second interior surface. The blade portion has a first axial dimension at a first location when intersected by the guide plane with the cutting member in the first position and a second axial dimension at a second location when intersected by the guide plane with the cutting member in the second position. The first axial dimension is approximately equal to the second axial dimension. In one aspect of the invention, the first and second axial dimensions can be approximately 0.250 inch. In another aspect of the invention, a lateral dimension of the blade portion when intersected by the guide plane can be approximately 0.250 inch. In yet another aspect of the invention, the blade assembly can be configured to rotate as a unit through an arc having a radius of less than three inches about an axis extending transverse to the guide plane.

The invention is also directed toward a method for severing fiber-cement materials. In one aspect of the invention, the method includes engaging a first surface of the fiber-cement with engaging surfaces of two spaced apart finger portions of a severing tool such that the engaging surfaces define a guide plane. The method can further include aligning a blade of the severing tool between the fingers of the tool with the blade facing a second surface of the fiber-cement opposite the first surface. The blade is reciprocated between the fingers in a direction transverse to the guide plane between a first position and a second position. The blade has an axial dimension defined by the intersection of the blade in the guide plane. The axial dimension of the blade is approximately the same when the blade is in both the first and second positions. A first portion of the fiber-cement is separated from a second portion of the fiber-cement along an arcuate path by turning the severing tool about an axis transverse to at least one of the first and second surfaces of the fiber-cement.

DETAILED DESCRIPTION OF THE INVENTION

The present invention is an apparatus for cutting fiber-cement siding and/or other fiber-cement products. Many specific details of certain embodiments of the invention are set forth in the following description and in FIGS. 1–5 to provide a thorough understanding of such embodiments. One skilled in the art, however, will understand that the present invention may have additional embodiments, or that the invention may be practiced without several of the details described in the following description.

Figure 1:
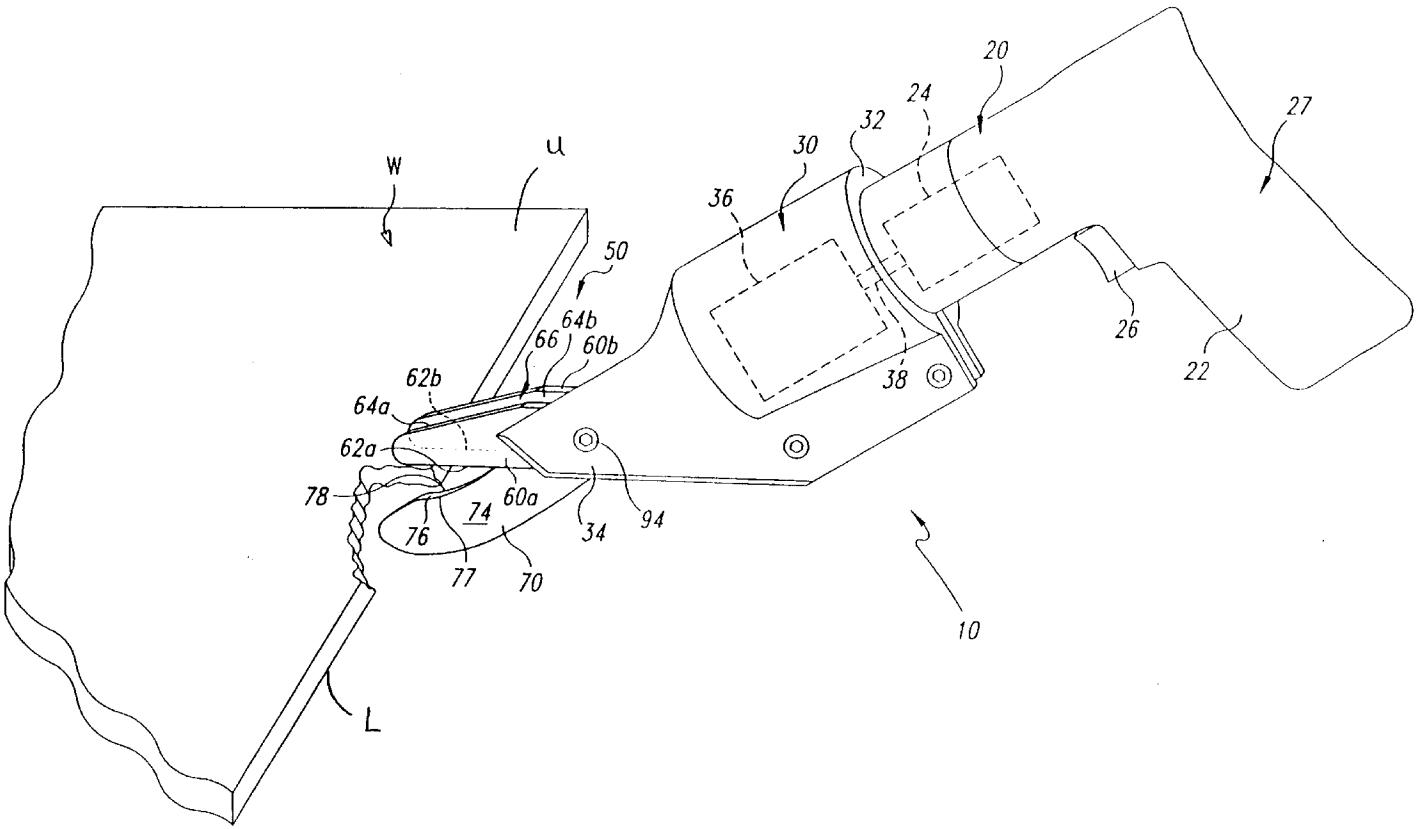
FIG. 1 is an isometric view of a fiber-cement cutting tool and a blade set in accordance with one embodiment of the invention.

FIG. 1 is an isometric view of a hand-held cutting tool 10 for cutting a fiber-cement material (FCM) workpiece W. The workpiece W has an upper surface U and a lower surface L. The cutting tool 10 has a motor unit 20 with a housing 22, a motor 24 (shown schematically in phantom) inside the housing 22, and a switch 26 operatively coupled to the motor 24. The housing 22 preferably has a handle 27 configured to be gripped by an operator. One suitable motor unit 20 is the No. 3208-90 electric motor unit manufactured by Black and Decker Corporation. Another suitable motor unit 20 is the No. 7802 pneumatic motor unit manufactured by Ingersoll-Rand Corporation.

The output of the motor unit 20 may be converted into a reciprocal motion with a head 30 having a casing 32 and a reciprocating drive assembly 36 (shown schematically in phantom). The casing 32 is attached to the housing 22 of the motor unit 20. Additionally, the reciprocating drive assembly 36 is coupled to the motor 24 via a gear assembly 38 (shown schematically in phantom) to translate the rotational output from the motor unit 20 into a reciprocating motion. A suitable head 30 is the shear head manufactured by Kett Tool Co., as set forth by U.S. Pat. No. 4,173,069, entitled "Power Shear Head," which is herein incorporated by reference.

The cutting tool 10 may also have a blade set or assembly 50 with a first finger 60*a* attached to one side of the head 30, a second finger 60*b* attached to another side of the head 30, and a cutting member 70 between the first and second fingers 60*a* and 60*b*. In one embodiment, the first finger 60*a* is separable from the second finger 60*b*. Alternatively, the first and second fingers 60*a*, 60*b* can be portions (for example, integral portions) of a single alignment member. In either embodiment, the first finger 60*a* has a guide surface 62*a* and a first interior surface 64*a*. Similarly, the second finger 60*b* has a second guide surface 62*b* (shown in phantom) and a second interior surface 64*b*. The first and second fingers 60*a* and 60*b* are preferably attached to the head 30 to space the first and second interior surfaces 64*a* and 64*b* apart from one another by a gap 66 in which the cutting member 70 may be received. Additionally, the first and second guide surfaces 62*a* and 62*b* are preferably straight to rest flat on the upper surface U of the FCM workpiece W for aligning the cutting member 70 with the workpiece W.

Figure 2:
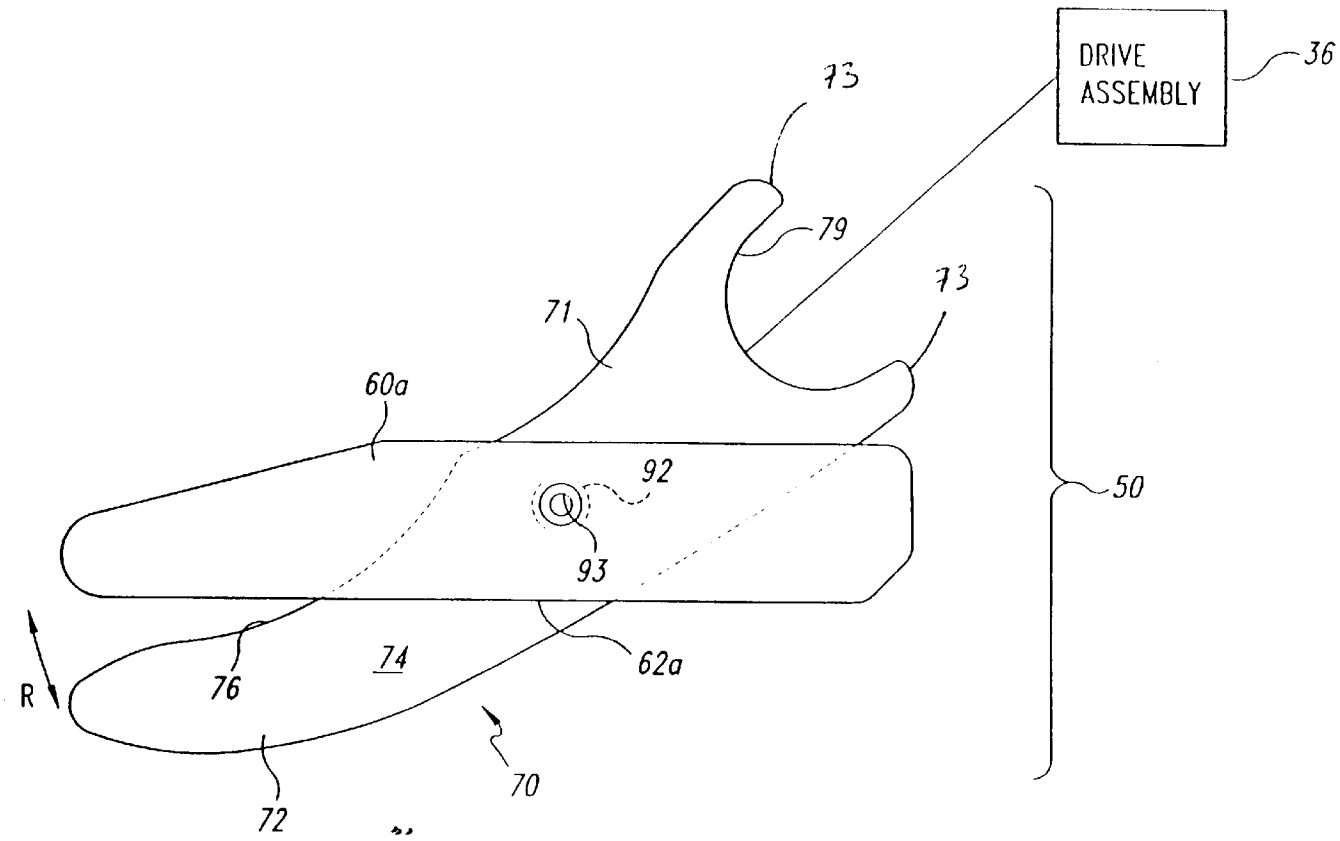
FIG. 2 is a side elevational view of the blade set of FIG. 1.
Figure 3:
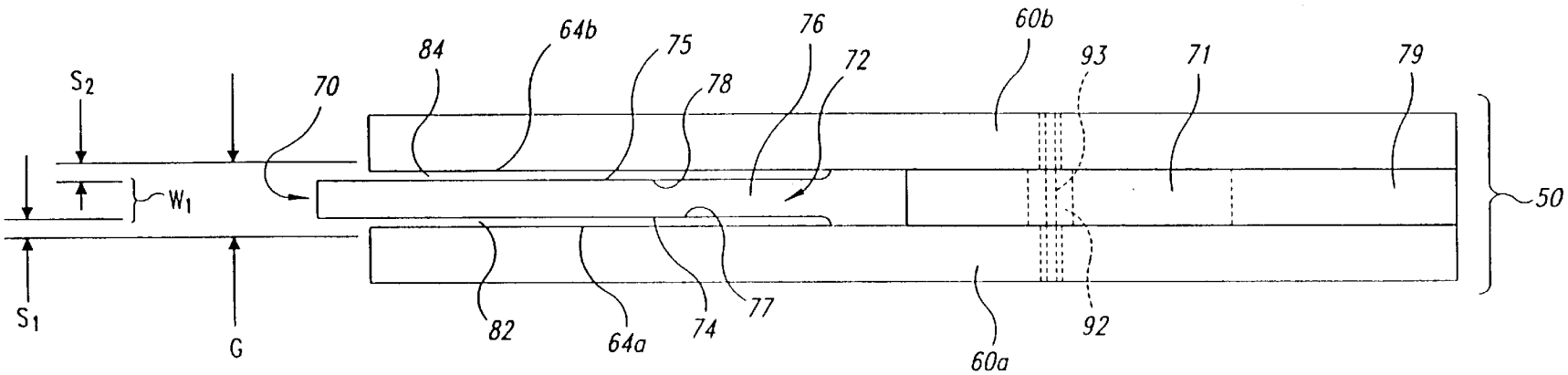
FIG. 3 is a top plan view of the blade set of FIG. 1.

FIG. 2 is a side elevational view and FIG. 3 is a top plan view of the blade assembly 50 used with the FCM cutting tool 10. The cutting member 70 may have a body 71 with a first width approximately equal to a gap distance G between the first interior surface 64*a* of the first finger 60*a* and the second interior surface 64*b* of the second finger 60*b*. The cutting member 70 may also have a blade 72 projecting from the body 71 between the first and second fingers 60*a* and 60*b*. The blade 72 has a first side surface 74 facing opposite the first interior surface 64*a*, a second side surface 75 facing opposite the second interior surface 64*b*, and a curved top surface 76. The edge along the top surface 76 and the first side surface 74 defines a first cutting edge 77 (best shown in FIG. 1), and the edge along the top surface 76 and the second side surface 75 defines a second cutting edge 78 (best shown in FIG. 1).

In a particular embodiment, the first side surface 74 is spaced apart from the first interior surface 64*a* by a distance $S_1$ to define a first side space 82. Similarly, the second side surface 75 is spaced apart from the second interior surface 64*b* by a distance $S_2$ to define a second side space 84. The spacing between the sides 74 and 75 of the blade 72 and the interior surfaces 64*a* and 64*b* of the fingers 60*a*, 60*b* may be a function of the overall gap width G between the fingers 60*a* and 60*b*. Additionally, the spacing between the sides of the blade and the fingers may be a function of the thickness of the FCM workpiece W. For example, when the FCM workpiece W has a thickness of between 0.25 and 0.3125 inches, the distances $S_1$ and $S_2$ are between 0.040–0.055 inches and the gap width G is 0.25 inches. More preferably, the distances $S_1$ and $S_2$ are between 0.0425–0.045 inches. The distances $S_1$ and $S_2$ of each of the spaces 82 and 84, therefore, may be approximately 16% to 22% of the gap width G between the fingers 60*a* and 60*b*, and preferably between 17% and 18% of the gap width G.

The spacing between the sides of the blade 72 and the fingers 60*a* and 60*b* may be selected by adjusting the thickness of the top surface 76 of the blade 72. For a gap width G of 0.25 inches between the fingers 60*a* and 60*b*, the top surface 76 of the blade 72 may be 0.140–0.170 inches wide, and is preferably between 0.160 and 0.165 inches wide. Additionally, the top surface 76 may have a curvature that is concave with respect to the guide surfaces 62*a* and 62*b* of the fingers 60*a* and 60*b*. As best shown in FIG. 1, therefore, the first and second cutting edges 77 and 78 are also concave with respect to the FCM workpiece W. The curvature of the top surface 76 may be a radius between 1.5 and 2.0 inches, and is preferably approximately 1.75 inches.

The reciprocating cutting member 70 is pivotally coupled to the first and second fingers 60*a* and 60*b* by a bushing 92 (FIGS. 2 and 3). Additionally, the bushing 92 has an opening 93 (FIG. 2) to receive a bolt 94 (FIG. 1) that passes through the head 30 (FIG. 1). The reciprocating cutting member 70 also has a driven end 79 configured to engage the reciprocating drive assembly 36 of the head 30. The driven end 79 can have a fork shape with two spaced apart teeth 73 that are alternately engaged by a rotating cam of the drive assembly 36.

In operation, the motor 24 moves the drive assembly 36 when an operator depresses the switch 26. The drive assembly 36 reciprocates the blade 72 of the cutting member 70 along a reciprocating path R (FIG. 2) between an open position (FIGS. 1 and 2) and a closed position (not shown) in which the top surface 76 of the blade 72 is above the guide surfaces 62*a* and 62*b* of the fingers 60*a* and 60*b*. In one embodiment, the blade 72 reciprocates at approximately 0–3,000 strokes per minute. As the blade 72 moves from the open position to the closed position, the first cutting edge 77 and the first interior surface 64*a* shear the FCM workpiece W along one line, and the second cutting edge 78 and the second interior surface 64*b* shear the FCM workpiece along a parallel line. The top surface 76 accordingly lifts and separates a cut section (not shown) of the FCM workpiece W with each upward stroke of the blade 72. To cut a continuous line through the workpiece W, an operator pushes the cutting tool 10 across the workpiece W as the blade 72 reciprocates.

The motor 24 and the drive assembly 36 of the cutting tool 10 have significantly lower failure rates than the original hand-held tool developed by the present inventors. One aspect of the invention is that the inventors discovered that the binder and the cellulose in FCM causes significant friction between the FCM and the cutting blade at the very high velocities of the cutting blade 72. The inventors believe that the heat generated from the blade 72 melts the binder and/or the cellulose, and that the melted matter increases the friction between the blade 72 and the FCM workpiece W. From this discovery, the inventors further discovered that increasing the size of the spaces 82 and 84 between the blade 72 and the fingers 60*a* and 60*b* significantly reduced premature failure of the motor 24 and the drive assembly 36. The inventors believe that increasing the spaces 82 and 84 reduces the friction between the cutting blade 72 and the workpiece 10. More specifically, for a ¼ inch or 5/16 inch thick FCM workpiece, the side distances $S_1$ and $S_2$ between the blade 72 and the first and second fingers 60*a* and 60*b* are between 0.040 and 0.055 inches instead of being 0.025–0.0325 inches in the original hand-held tool developed by the present inventors. The blade set 50 accordingly increases the side distances $S_1$ and $S_2$ by approximately 23%–120%. Thus, by increasing the spaces 82 and 84, blade set 50 enhances the operational life of the motor 24 and the drive assembly 36.

The cutting tool 10 with the blade set 50 also produces a clean, straight edge along the cut. Because FCM tends to rip or crack along unpredictable lines when it is cut with a thin blade, the art generally taught that it is better to minimize the space between the blade 72 and the fingers 60*a* and 60*b* to create a more defined shear region in an FCM workpiece. Nonetheless, in contrast to the art, the blade set 50 increases the distances $S_1$ and $S_2$ between the blade 72 and the first and second fingers 60*a* and 60*b* without sacrificing the quality of the cut. Thus, the blade set 50 of the cutting tool 10 not only provides a cost effective solution for reducing the premature failure of the motor 24 and the drive assembly 36, but it also produces a clean edge along the cut.

The particular dimensions for the blade set 50 described above with reference to FIGS. 1–3 are particularly useful for cutting ¼ inch and 5/16 inch thick FCM workpieces. It is expected that the side distances $S_1$ and $S_2$ between the blade 72 and the first and second fingers 60*a* and 60*b* may be varied according to the thickness of the particular FCM workpiece. Accordingly, the side distances $S_1$ and $S_2$ are preferably between 13% and 22% of the thickness of the FCM workpiece being cut. Additionally, the top surface 76 of the blade 72 is preferably between 44% and 68% of the thickness of the particular FCM workpiece. Therefore, the particular dimensions of the blade set 50 for cutting FCM siding may be adjusted relative to the FCM workpiece W.

Figure 4:
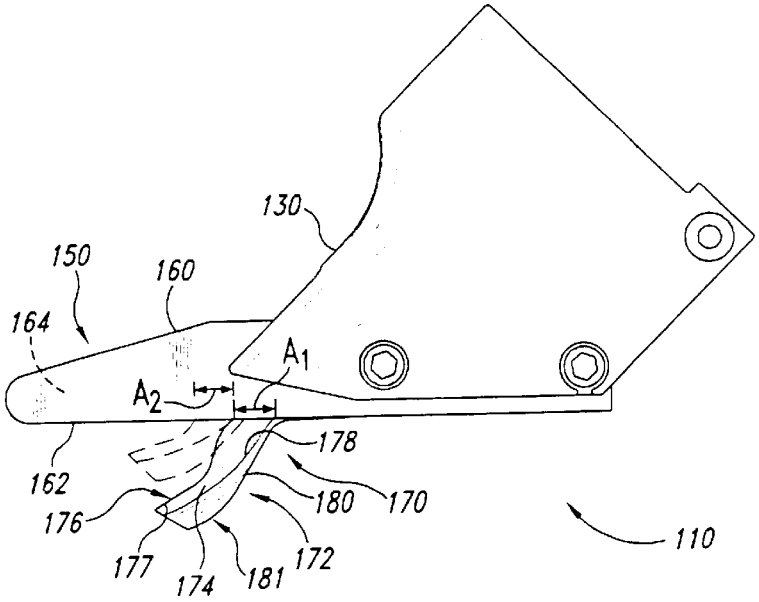
FIG. 4 is a side elevational view of a blade assembly and a head for making reduced-radius cuts in a fiber-cement material in accordance with another embodiment of the invention.
Figure 5:
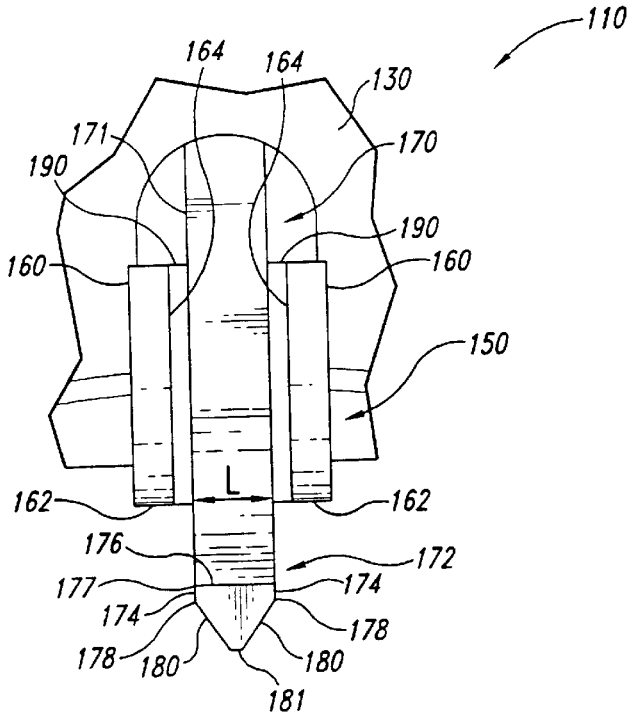
FIG. 5 is a front end view of the blade assembly and head shown in FIG. 4.

FIG. 4 is a side elevational view and FIG. 5 is a front end view of a portion of an FCM cutting tool 110 having a blade assembly 150 configured for cutting cured or uncured FCM along a reduced-radius arcuate path in accordance with another embodiment of the invention. In one aspect of this embodiment, the tool 110 includes a head 130 generally similar to the head 30 discussed above with reference to FIG. 1. Accordingly, the head 130 can be coupled to the motor unit 20 (FIG. 1) to operate the blade assembly 150 in a manner generally similar to that discussed above.

In one embodiment, the blade assembly 150 includes two spaced apart fingers 160 (FIG. 5), and each finger 160 has a guide surface 162 and an interior surface 164. The guide surfaces 162 define a guide plane that extends transverse to the plane of FIGS. 4 and 5. The blade assembly 150 can further include a cutting member 170 pivotally coupled to the head 130 between the fingers 160. The cutting member 170 has a blade portion 172 that projects below the guide surfaces 162. The blade portion 172 reciprocates relative to the fingers 160 between a first position (shown in solid lines in FIG. 4) and a second position (shown in phantom lines in FIG. 4) to cut or sever a piece of FCM.

In one aspect of the embodiment shown in FIGS. 4 and 5, the blade portion 172 has a top surface 176 and a bottom surface 181. The blade portion 172 also has generally flat side surfaces 174 that face opposite the interior surfaces 164 of the fingers 160. In one aspect of this embodiment, the side surfaces 174 are generally parallel to the interior surfaces 164 of the fingers 160 and extend from a top edge 177 (where the side surfaces 174 intersect the top surface 176) to an intermediate edge 178. The cutting member 170 also can have canted surfaces 180 extending from the intermediate edge 178 to the bottom surface 181 and converging toward each other.

In one embodiment best shown by FIG. 4, the side surfaces 174 have a first axial dimension $A_1$ defined by the intersection between the guide plane and the cutting member 170 when the cutting member 170 is in the first position. The side surfaces 174 have a second axial dimension $A_2$ defined by the intersection between the guide plane and the cutting member 170 when the cutting member 170 in the second position. In one aspect of this embodiment, the axial dimensions $A_1$ and $A_2$ can be approximately equal. In another aspect of this embodiment, the axial dimensions $A_1$ and $A_2$ can approximately equal the axial dimension of the side surfaces 174 (defined by the intersection between the guide plane and the cutting member 170) when the cutting member 170 is at any of the intermediate positions between the first position and the second position. Accordingly, the top edge 177 and the intermediate edge 178 of the cutting member 170 can define an s-shape or a portion of an s-shape.

In operation, the tool 110 can be rotated about an axis normal to the guide plane during cutting to sever the workpiece W (FIG. 1) along an arcuate path in the guide plane. In one aspect of the operation, the minimum radius about which the tool 110 can rotate as it cuts is determined by the axial dimensions $A_1$ and $A_2$. For example, in a method in accordance with one embodiment of the invention, the tightest cutting radius can be obtained by pivoting the tool 110 about the intermediate edge 178, with the radius of the cut approximately equal to the axial dimensions $A_1$ and $A_2$. In one aspect of this embodiment, the axial dimensions $A_1$ and $A_2$ of the cutting member 170 can be approximately 0.250 inch. In other embodiments, the axial dimensions $A_1$ and $A_2$ can be larger or smaller to control the minimum radius cut made by the tool 110 and provide sufficient durability to cut abrasive fiber-cement materials. Of course, the cutting tool 110 can also be operated to make straight cuts and arcuate cuts having a radius larger than the minimum radius.

Referring to FIG. 5, the cutting member 170 includes a body portion 171 generally similar to the body portion 71 described above with reference to FIG. 2. The body portion 171 is coupled to the blade portion 172. In one embodiment, two spacers 190 offset the blade portion 172 inwardly from the interior surfaces 164 of the fingers 160. Alternatively, the cutting member 170 can taper inwardly from the body portion 171 to the blade portion 172. In either embodiment, at least a portion of each side surface 174 of the blade portion 172 is restricted from contacting the fingers 160 as the blade portion 172 reciprocates up and down between the fingers 160.

The side surfaces 174 join with the tapered surfaces 180 at the intermediate edges 178, and the tapered surfaces 180 cant inwardly toward each other as they extend toward the bottom surface 181. Accordingly, the tapered surfaces 180 generally do not contact with the workpiece W as the cutting member 170 reciprocates and the cutting tool 110 moves along an arcuate path through the workpiece W. As a result, the tapered surfaces 180 do not limit the minimum radius of the cut made by the cutting tool 110, but instead the minimum radius is determined by the axial dimensions $A_1$ and $A_2$.

The blade portion 172 can have a lateral dimension L transverse to the axial dimensions $A_1$ and $A_2$ (FIG. 4). In one aspect of this embodiment, the length of the lateral dimension L can be closer to the length of the axial dimensions $A_1$ and $A_2$ as compared to other shear-type devices. For example, when the axial dimensions $A_1$ and $A_2$ are approximately 0.250 inch, the lateral dimension L can also be approximately 0.250 inch. Accordingly, the ratio of the axial dimensions $A_1$ and $A_2$ to the lateral dimension L can be about 0.8–1.2, and are preferably about 1.0. In either of these embodiments, the tool 110 can more easily cut a sharp radius (and can effectively pivot about the intermediate edge 178 of the cutting member 170) because the axial dimensions $A_1$ and $A_2$ are approximately the same as or less than the lateral dimension L.

One feature of an embodiment of the cutting tool 110 described above with reference to FIGS. 4 and 5 is that the tool 110 can cut an arcuate path having a minimum radius of 0.250 inch or less. This is unlike some conventional tools, which can cut a minimum radius of about three inches. Accordingly, in one embodiment, the cutting tool 110 can have any combination of axial dimensions $A_1$ and $A_2$ and lateral dimension L that allow the tool 110 to cut a radius less than three inches, and more preferably less than 1.0 inch.

Another feature of an embodiment of the tool 110 described above with reference to FIGS. 4 and 5 is that the axial dimension of the blade portion 172 intersected by the guide plane remains approximately constant as the blade portion reciprocates between the fingers 160. Accordingly, the blade portion 172 can have an s-shape when viewed from the side. As a result, the minimum radius capability of the cutting tool 110 remains approximately constant as the cutting member 170 moves between the first and second positions. In other embodiments, the blade portion 172 can have other profile shapes, depending on the type of motion the blade portion 172 describes as it moves relative to the fingers 160. For example, the blade portion 172 may have a different shape if it translates (rather than pivots) up and down relative to the fingers 160.

From the foregoing it will be appreciated that, although specific embodiments of the invention have been described herein for purposes of illustration, various modifications may be made without deviating from the spirit and scope of the invention. For example, the first and second fingers may be attached to the motor unit instead of the head. Accordingly, the invention is not limited except as by the appended claims.

What is claimed is:

1. A blade assembly for a reciprocating fiber-cement cutting tool, comprising:

an alignment member attachable to the cutting tool and having a first finger portion with a first guide surface and a first interior surface transverse to the first guide surface, the alignment member further having a second finger portion with a second guide surface and a second interior surface transverse to the second guide surface, the first and second guide surfaces defining a guide plane, and the first and second interior surfaces being spaced apart from one another; and a reciprocating cutting member between the first and second finger portions and moveable relative to the finger portions along a path transverse to the guide plane between a first position and a second position, the cutting member having a blade portion projecting from the guide plane when the cutting member is in at least one of the first and second positions, the blade portion having a first side surface facing an opposite direction from the first interior surface of the first finger portion and a second side surface facing an opposite direction from the second interior surface of second finger portion, the blade portion having a first axial dimension at a first location when intersected by the guide plane with the cutting member in the first position and a second axial dimension at a second location when intersected by the guide plane with the cutting member in the second position, the first axial dimension being approximately equal to the second axial dimension.

2. The blade assembly of claim 1 wherein the cutting member has a cutting surface between the first and second side surfaces, further wherein the cutting surface defines an s-shape.

3. The blade assembly of claim 1 wherein the first axial dimension is about 0.250 inch or less.

4. The blade assembly of claim 1 wherein the blade portion has a lateral dimension transverse to the first axial dimension and a ratio of the first axial dimension to the lateral dimension is about 1.0 or less.

5. The blade assembly of claim 1 wherein the blade portion has a lateral dimension transverse to the first axial dimension and a ratio of the first axial dimension to the lateral dimension is about 0.8 to about 1.2.

6. The blade assembly of claim 1 wherein the cutting member and the first and second finger portions are rotatable as a unit through an arc having a radius of less than three inches about an axis extending transverse to the guide plane.

7. The blade assembly of claim 1 wherein the cutting member and the first and second finger portions are rotatable as a unit through an arc having a radius of less than 1.0 inch about an axis extending transverse to the guide plane.

8. The blade assembly of claim 1, further comprising a first spacer between the first finger portion and the cutting member and a second spacer between the second finger portion and the cutting member.

9. A blade assembly for a reciprocating fiber-cement severing tool, comprising:

a first finger having a first guide surface and a first interior surface, the first finger being attachable to the cutting tool;

a second finger having a second guide surface and a second interior surface, the second finger being attachable to the cutting tool to position the first and second guide surfaces in a guide plane and to space the first and second interior surfaces apart from one another; and a reciprocating cutting member between the first and second fingers, the cutting member having a blade portion projecting from the guide plane, the blade portion having a first side surface facing an opposite direction from the first interior surface of the first finger and a second side surface facing an opposite direction from the second interior surface of second finger, the blade portion having an axial dimension and a lateral dimension when intersected by the guide plane with the lateral dimension transverse to the axial dimension and transverse to the interior surfaces of the fingers and a ratio of the axial dimension to the lateral dimension being about 1.0 or less.

10. The blade assembly of claim 9 wherein the axial dimension is about 0.250 inch.

11. The blade assembly of claim 9 wherein the lateral dimension is about 0.25 inch.

12. The blade assembly of claim 9 wherein the cutting member and the first and second fingers are rotatable as a unit through an arc having a radius of less than three inches about an axis extending transverse to the guide plane.

13. A blade assembly for a reciprocating fiber-cement severing tool, comprising:

a first finger having a first guide surface and a first interior surface, the first finger being attachable to the severing tool;

a second finger having a second guide surface and a second interior surface, the second finger being attachable to the severing tool to position the first and second guide surfaces in a guide plane and to space the first and second interior surfaces apart from one another; and a reciprocating cutting member between the first and second fingers for severing fiber-cement along a cutting path, the cutting member having a blade portion projecting from the guide plane, the blade portion having a first side surface facing an opposite direction from the first interior surface of the first finger and a second side surface facing an opposite direction from the second interior surface of second finger, the blade portion having an axial dimension along the cutting axis when intersected by the guide plane of about 0.250 inch or less.

14. The blade assembly of claim 13 wherein the cutting member has a lateral dimension transverse to the axial dimension when intersected by the guide plane and a ratio of the axial dimension to the lateral dimension is about 1.0.

15. The blade assembly of claim 13 wherein the cutting member and the first and second fingers are rotatable as a unit through an arc having a radius of less than three inches about an axis extending transverse to the guide plane.

16. The blade assembly of claim 13 wherein the cutting member has a generally triangular cross-sectional shape when intersected by a plane transverse to the guide plane.

17. A blade set for a reciprocating fiber-cement cutting tool, comprising:

a first finger having a first guide surface and a first interior surface, the first finger being attachable to the cutting tool;

a second finger having a second guide surface and a second interior surface, the second finger being attachable to the cutting tool to position the first and second guide surfaces in a guide plane and to space the first and second interior surfaces apart from one another; and a reciprocating cutting member pivotally coupled between the first and second fingers, the cutting member having a blade portion projecting from the guide plane, the blade portion having a first side surface facing an opposite direction from the first interior surface of the first finger and a second side surface facing an opposite direction from the second interior surface of second finger, the blade portion being configured to make an arcuate cut in the fiber-cement having a radius of less than three inches.

18. The blade set of claim 17 wherein the cutting member has an axial dimension when intersected by the guide plane of about 0.250 inch or less.

19. The blade set of claim 17 wherein the cutting member is pivotable relative to the first and second fingers between a first position and a second position, further wherein the cutting member has a first axial dimension when intersected by the guide plane with the cutting member in the first position and a second axial dimension when intersected by the guide plane with the cutting member in the second position, the first axial dimension and the second axial dimension being approximately equal.

20. The blade set of claim 19 wherein the blade portion has a lateral dimension transverse to the first axial dimension and a ratio of the first axial dimension to the lateral dimension is about 1.0 or less.

21. The blade set of claim 17 wherein the cutting member and the first and second fingers are rotatable as a unit through an arc having a radius of less than three inches about an axis extending transverse to the guide plane.

22. An apparatus for severing fiber-cement, comprising:

a cutting head;

a first finger attached to the cutting head and having a first guide surface and a first interior surface transverse to the first guide surface;

a second finger attached to the cutting head and spaced apart from the first finger, the second finger having a second guide surface and a second interior surface transverse to the second guide surface, the first and second guide surfaces defining a guide plane;

a reciprocating cutting member between the first and second fingers and moveable relative to the fingers along a path transverse to the guide plane between a first position and a second position, the cutting member having a blade portion projecting from the guide plane when the cutting member is in at least one of the first and second positions, the blade portion having a first side surface facing an opposite direction from the first interior surface of the first finger and a second side surface facing an opposite direction from the second interior surface of second finger, the blade portion having a first axial dimension at a first location when intersected by the guide surface plane with the blade in the first position and a second axial dimension at a second location when intersected by the guide surface plane with the blade in the second position, the first axial dimension being approximately equal to the second axial dimension; and a drive assembly coupled to the reciprocating cutting member, at least a portion of the drive assembly being movable with the cutting member between the first and second positions.

23. The apparatus of claim 22 wherein the cutting head includes an aperture having a first end and a second end opposite the first end, further wherein the cutting member has a fork portion extending into the first end of the aperture, the fork portion including two spaced apart teeth, further wherein the drive assembly includes a drive shaft rotatable relative to the cutting head and extending into the second end of the aperture, the drive shaft having an eccentric lobe positioned between the teeth of the blade, the drive shaft being rotatable relative to the cutting head.

24. A method for severing fiber-cement, comprising:

engaging a first surface of the fiber-cement with guide surfaces of two spaced apart finger portions of a severing tool, the engaging surfaces defining a guide plane;

aligning a blade of the severing tool between the fingers of the severing tool with the blade facing a second surface of the fiber-cement;

reciprocating the blade between the fingers in a direction transverse to the guide plane between a first position and a second position with an axial dimension of the blade when intersected by the guide plane being approximately the same when the blade is in both the first and second positions; and separating a first portion of the fiber-cement from a second portion of the fiber-cement along an arcuate path by turning the severing tool about an axis transverse to at least one of the first and second surfaces of the fiber-cement.

25. The method of claim 24 wherein turning the severing tool includes turning the blade through an arc having a radius of less than three inches.

26. The method of claim 24 wherein turning the severing tool includes turning the blade through an arc having a radius of about 0.250 inch or less.

27. A method for severing fiber-cement, comprising:

engaging a first surface of the fiber-cement with engaging surfaces of two spaced apart fingers of a severing tool, the engaging surfaces defining a guide plane;

aligning a blade of the severing tool between the fingers of the severing tool with at least a portion of the blade facing a second surface of the fiber-cement, the second surface facing opposite the first surface;

reciprocating the blade between the fingers in a direction transverse to the guide plane; and separating a first portion of the fiber-cement from a second portion of the fiber-cement along an arcuate path by turning the severing tool through an arc having a radius less than three inches about an axis transverse to at least one of the first and second surfaces of the fiber-cement.

28. The method of claim 27 wherein severing the first portion of the fiber-cement includes turning the severing tool through an arc having a radius of about 0.250 inch or less.

29. The method of claim 27 wherein reciprocating the blade includes engaging a portion of the blade with a rotating eccentric cam lobe.

* * * * *